US005237377A

United States Patent [19]

Harada et al.

[11] Patent Number: 5,237,377

[45] Date of Patent: Aug. 17, 1993

[54] CLEANING DEVICE FOR DRY ELECTROPHOTOGRAPHIC DEVICE

[75] Inventors: Toshimitsu Harada, Ibaraki; Sadaki Maeda, Osaka; Shinichi Nishino, Ibaraki; Toshitaka Ogawa, Ibaraki; Masayasu Anzai, Ibaraki, all of Japan

[73] Assignee: Hitachi Koki Co., Ltd., Tokyo, Japan

[21] Appl. No.: 825,580

[22] Filed: Jan. 24, 1992

[30] Foreign Application Priority Data

Feb. 16, 1991 [JP] Japan ..... 3-42450

[51] Int. Cl.[5] ..... G03G 21/00

[52] U.S. Cl. ..... 355/301; 355/203; 355/296

[58] Field of Search ..... 355/298, 296, 301, 303, 355/302, 203-209, 305, 297; 118/652, 11; 15/256.51, 256.52

[56] References Cited

U.S. PATENT DOCUMENTS

| | | | |
|---|---|---|---|
| 3,893,416 | 7/1975 | Eichorn | 118/637 |
| 3,989,372 | 11/1976 | Davidge et al. | 15/256.52 X |
| 4,449,241 | 5/1984 | Nakagama | 118/699 |
| 4,791,455 | 12/1988 | Yamamoto et al. | 430/125 X |
| 4,870,466 | 9/1989 | Iida | 355/297 |
| 4,956,677 | 9/1990 | Akiyama | 355/303 |
| 4,969,015 | 11/1990 | Sanpe | 355/297 |
| 4,999,679 | 3/1991 | Corbin et al. | 355/303 |
| 5,010,819 | 4/1991 | Uribe et al. | 101/425 |
| 5,083,169 | 1/1992 | Usui et al. | 355/296 |
| 5,177,553 | 1/1993 | Ohike et al. | 355/301 |

FOREIGN PATENT DOCUMENTS

| | | | |
|---|---|---|---|
| 4203596 | 5/1992 | Fed. Rep. of Germany . | |
| 109970 | 7/1982 | Japan | 355/302 |

OTHER PUBLICATIONS

Abstract of Japan, P-258, vol. 8, No. 48.
Abstract of Japan, P-1118, vol. 14, No. 477.
Abstract of Japan, P-148, vol. 6, No. 203.
Abstract of Japan, P-1206, vol. 15, No. 205.

*Primary Examiner*—A. T. Grimley
*Assistant Examiner*—T. A. Dang
*Attorney, Agent, or Firm*—Sughrue, Mion, Zinn, Macpeak & Seas

[57] ABSTRACT

A cleaning device for a dry electrophotographic device includes a cleaning brush brought into resilient contact with an object to be cleaned such as a photosensitive drum. A cleaning roll rotates while constantly being brought into contact with the cleaning brush and a cleaning blade is pressed against the cleaning roll to clean the cleaning roll. A rotation direction switching mechanism switches the rotation direction of the cleaning brush such that the rotation direction of the cleaning brush when cleaning the object, for example, during the formation of an image, is different from that when the brush is not cleaning the object.

20 Claims, 3 Drawing Sheets

CLEANING DEVICE FOR DRY ELECTROPHOTOGRAPHIC DEVICE

BACKGROUND OF THE INVENTION

The present invention relates to a cleaning device for cleaning a photosensitive member, a transfer portion, or the like, in a dry electrophotographic device.

FIG. 6 shows a cleaning device in a conventional dry electrophotographic device in which toner 2, remaining on the surface of a photosensitive drum 1 after the respective processes of charging, exposure, development and transfer have been performed, is mechanically removed by a cleaning brush 3, or electrostatically removed when a brush bias-voltage applying mechanism 7 is employed. The toner 2 magnetically or electrostatically adhering to the cleaning roll 4 is scraped off mechanically by a cleaning blade 5 and is discharged from the device by a toner recovery screw 6.

Cleaning brush 3 has fine metallic bristles or the like, and cleaning roll 4 is brought into contact with cleaning brush 3 with a prescribed pressure so that toner 2 adhering to cleaning brush 3 can be transferred reliably to the cleaning roll 4.

Since the cleaning brush 3 and the cleaning roll 4 of the conventional cleaning device constantly and resiliently contact each other, the fine metallic bristles of the cleaning brush 3 are flattened over time. Therefore, the outer diameter of the cleaning brush 3 decreases gradually, so that the conventional cleaning device has a short service life in that the contact area between the cleaning brush 3 and the photosensitive drum gradually decreases, thereby deteriorating the cleaning capability of the cleaning device.

SUMMARY OF THE INVENTION

An object of the present invention is to overcome such disadvantages of the conventional systems and to provide a dry electrophotographic device having a cleaning device in which the service life of the cleaning brush is extended and a reliable cleaning capability of the cleaning device is maintained.

To attain the above-mentioned and other objects, a cleaning device for a dry electrophotographic device according to the present invention includes: a cleaning brush brought into resilient contact with an object to be cleaned such as a photosensitive drum, a photosensitive belt, or a transfer belt; a cleaning roll rotating while being brought into constant contact with the cleaning brush; a cleaning blade pressed against the cleaning roll, and a rotation direction switching device for switching the rotation direction of the cleaning brush such that the rotation direction of the cleaning brush when cleaning an object, for example, during the formation of an image, is different from that when the brush is not cleaning the object, for example, during a stand-by period for image formation.

As mentioned above, according to the present invention, the periodic or non-periodic change in the rotation direction of the cleaning brush prevents the collapse of the metallic bristles of the cleaning brush over time even when the cleaning roll constantly contacts the cleaning brush. Therefore, a dry electrophotographic device can be provided in which the contact area of the cleaning brush and the object to be cleaned is maintained and a high cleaning capability and high image quality are achieved.

BRIEF DESCRIPTION OF THE DRAWINGS

Other features and advantages of the present invention will be apparent from the following description when taken in connection with the accompanying drawings, in which.

DETAILED DESCRIPTION OF THE PREFERRED EMBODIMENTS

Figure 1:
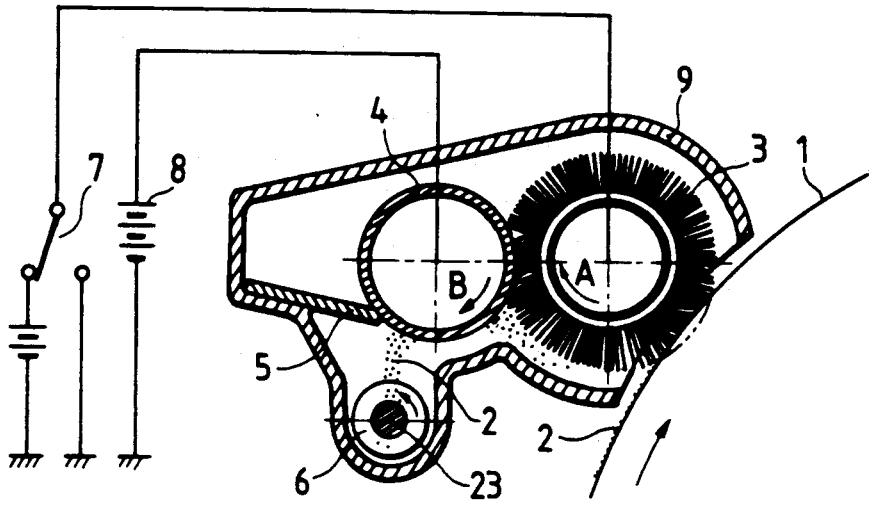
FIG. 1 is a sectional view of a cleaning device in a cleaning mode according to a first embodiment of the present invention.

Referring to FIGS. 1–4, a first embodiment according to the invention is illustrated in which residual toner 2 remaining on the surface of a photosensitive drum 1 after the respective processes of charging, exposure, development and transfer have been performed is electrostatically removed by a cleaning brush 3 which has a bias voltage applied thereto by a brush bias-voltage applying mechanism 7 and which rotates in the direction of an arrow A. The toner 2 adhering to the cleaning brush 3 is transferred to a cleaning roll 4, to which a bias voltage higher than that applied to the cleaning brush 3 is applied by a roll bias-voltage applying mechanism 8. Cleaning roll 4 rotates in the direction of arrow B, and the toner 2 is conveyed to and scraped off by a cleaning blade 5, and discharged out of the device by a toner recovery screw 6.

Figure 2:
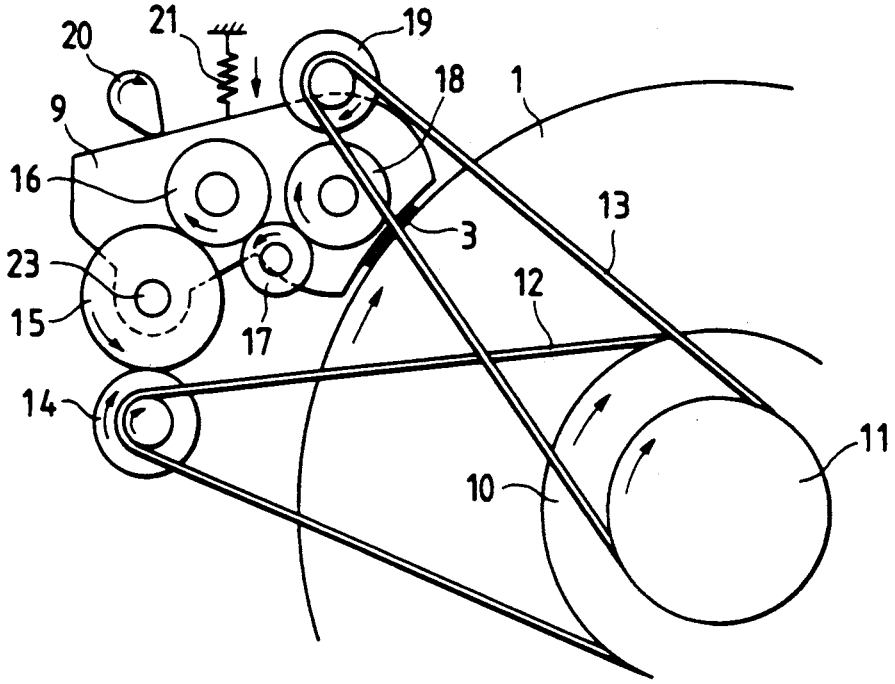
FIG. 2 is a view of a drive system for the cleaning device in the cleaning mode according to the first embodiment of the present invention.

As shown in FIG. 2, a case 9 is rotatably supported by a screw shaft 23 and contacts an eccentric cam 20. A retract spring 21 is connected to the case 9 which houses cleaning brush 3, the cleaning roll 4, the cleaning blade and the toner recovery screw 6 or the like, as shown in FIG. 1. Supported on the outside of the case 9 are a screw gear 15 connected to the toner recovery screw 6, a roll gear 16 connected to the cleaning roll 4 and a first brush gear 18 connected to the cleaning brush 3, as shown in FIG. 2. A cleaner drive gear 10, a brush drive gear 11, a cleaner gear 14, an idler gear 17 and a second brush gear 19 are provided in a main body of the device.

During a cleaning operation, the eccentric cam 20 is rotated against the tension of the retract spring 21, thereby to press the case 9 downwardly, as illustrated in FIG. 2. As a result, part of the cleaning brush 3 is brought into resilient contact with a prescribed area of the photosensitive drum 1, as shown in FIG. 1. The torque of the cleaner drive gear 10 provided coaxially with the rotational axis of the photosensitive drum 1, is transmitted to the cleaner gear 14 through a belt 12 to rotate the gear 14. The torque is transmitted in turn to the screw gear 15, the roll gear 16, the idler gear 17 and the first brush gear 18, thereby to rotate the cleaning brush 3 in the direction of arrow A such that the photosensitive drum 1 is cleaned, as mentioned above.

The torque of the brush drive gear 11, provided coaxially with the rotational axis of the photosensitive drum 1, is transmitted to the second brush gear 19 through a drive belt 13. However, the second brush gear 19 is provided separately from the first brush gear 18, so that it idly rotates.

Figure 3:
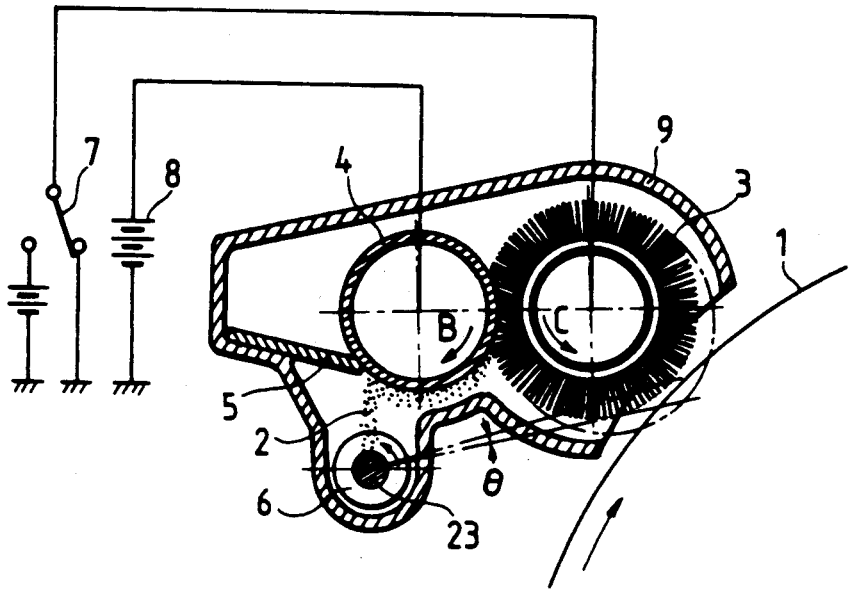
FIG. 3 is a sectional view of the cleaning device in a stand-by mode according to the first embodiment of the present invention.
Figure 4:
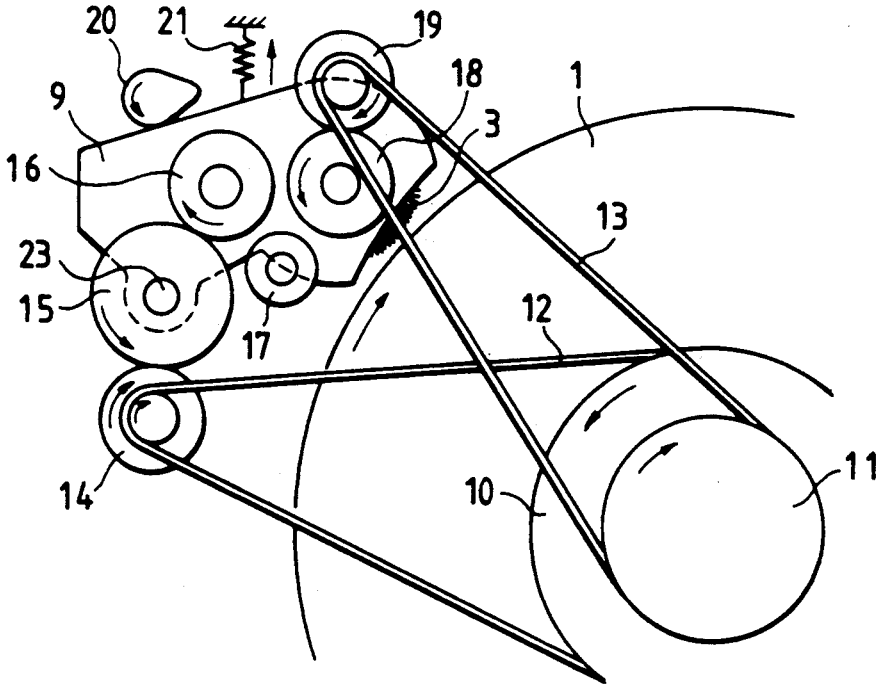
FIG. 4 is a view of a drive system for the cleaning device in a stand-by mode according to the first embodiment of the present invention.

On the other hand, when the cleaning device is in a stand-by mode or the like (e.g., when the cleaning device is not cleaning drum 1) immediately after the power is turned on, the second brush gear 19 is moved into the state shown in FIGS. 3 and 4. Specifically, when the eccentric cam 20 is rotated counterclockwise, as shown in FIG. 4, the case 9 is retracted to a stand-by position due to the tension of the retract spring 21 connected to the case 9. The movement of the case 9 disengages the first brush gear 18 from the idler gear 17 and engages the first brush gear 18 with the second brush gear 19, thereby separating the cleaning brush 3 from the photosensitive drum 1, as shown in FIG. 3.

When the first brush gear 18 thus engages the second brush gear 19, the cleaning brush 3 rotates in the direction of arrow C opposite to that during a cleaning operation (e.g., the direction of arrow A), as shown in FIG. 3. The brush bias-voltage applying mechanism 7 is switched to a ground position substantially simultaneously with changing the rotation direction (e.g., from the direction of arrow A to that of arrow C) of the cleaning brush 3 such that bias voltage is not applied to the cleaning brush 3. As a result, toner is easily removed from the cleaning brush 3 by the cleaning roll 4. The rotation of the eccentric cam 20 is synchronous with the actuation of a member when an image is formed, such as a print switch.

Figure 5:
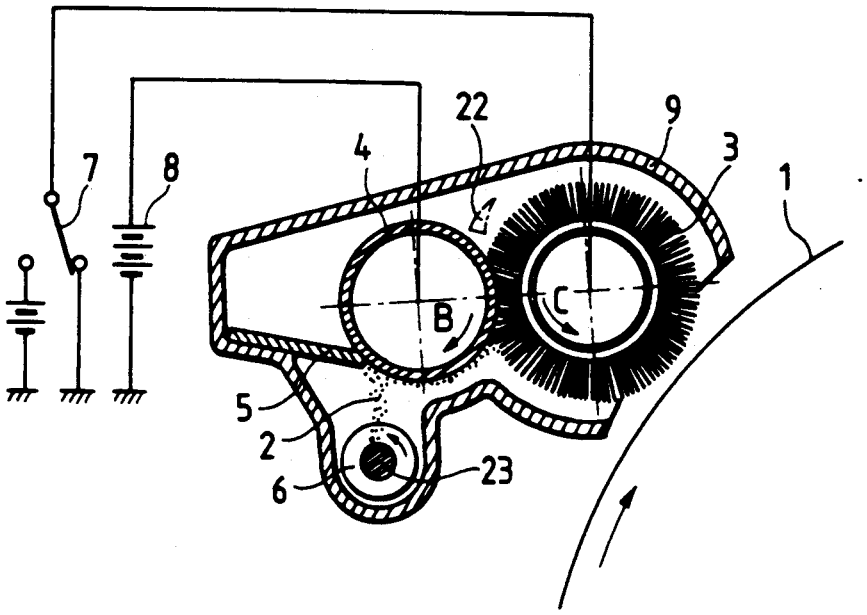
FIG. 5 is a sectional view of a cleaning device in a stand-by mode according to a second embodiment of the present invention.
Figure 6:
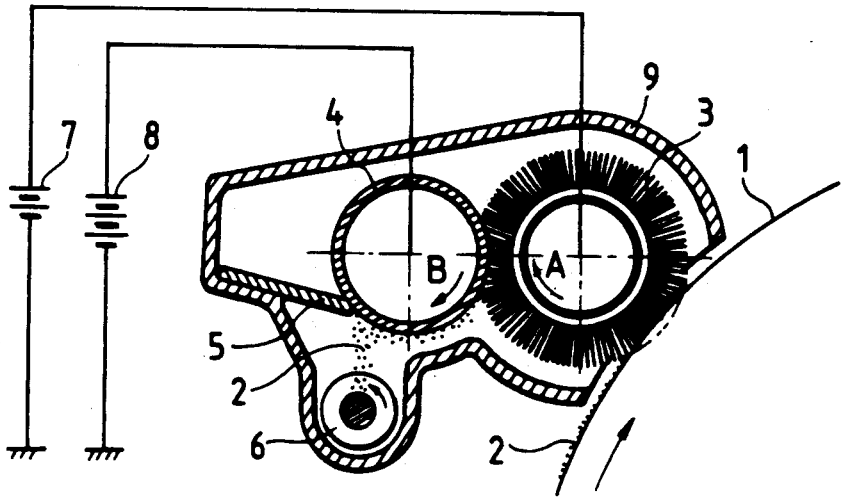
FIG. 6 PRIOR ART
FIG. 6 is a sectional view of a conventional cleaning device in a cleaning mode.

Referring to FIG. 5, a cleaning device according to a second embodiment of the present invention includes a flicker bar 22 rotatably provided at an upstream side from a contact portion of a cleaning brush 3 and a cleaning roll 4 in the rotation direction (e.g., in the direction of arrow B) of the cleaning roll 4.

Flicker bar 22 is out of contact with the cleaning brush 3 during a cleaning operation (e.g., when brush 3 is rotating in the direction of arrow A), as shown by the dotted lines in FIG. 5. Substantially simultaneously with the cleaning brush 3 being brought into a stand-by position and rotating in direction C opposite to that during a cleaning operation, the flicker bar 22 is rotated to a position shown by the solid lines and comes into contact with the cleaning brush 3 with a prescribed contact depth. The contact between the flicker bar 22 and the cleaning brush 3 separates toner from the cleaning brush 3. Since the drive system in the second embodiment is similar to that of the first embodiment, the explanation thereof will be omitted.

The flicker bar 22 may be made of conductive material and a bias voltage may be applied or grounded when the flicker bar 22 is brought into contact with the cleaning brush 3 to assist in removing toner from the cleaning brush 3. The flicker bar 22 also may be brought into constant contact with the cleaning brush 3.

In the first and second embodiments, although the brush bias-voltage applying mechanism 7 is switched to ground under a stand-by state, a reverse bias voltage may be applied to the cleaning brush 3 instead.

Further, although separate mechanisms are employed to change the rotation direction of the cleaning brush 3, the present invention is not restricted thereto. For example, a drive device such as a motor may be directly connected to the cleaning brush 3, thereby to change the rotation direction thereof.

Although the aforementioned embodiments are directed to cleaning a photosensitive drum, the present invention is not restricted thereto. Thus, it will be readily appreciated that the invention may be applied to, for example, a photosensitive belt, a transfer belt or a transfer roller.

As described above, according to the present invention, the periodic or non-periodic change in the rotation direction of the cleaning brush prevents the fine metallic bristles of the cleaning brush from collapsing over time even when the cleaning brush is brought into constant contact with the cleaning roll. Therefore, a dry electophotographic device can be provided, in which the contact area of the cleaning brush and an object to be cleaned is reliably maintained so that a high cleaning capability and high image quality are achieved.

While certain preferred embodiments have been shown and described, many changes and modifications within the spirit of the invention will be apparent to those of working skill in this technical field. Thus, the scope of the invention should be considered as limited only by the appended claims.

What is claimed is:

1. A cleaning device for a dry electrophotographic device adapted to clean an object, comprising:

a rotatable cleaning brush selectively movable between a first position and a second position to move into contact and out of contact with the object, respectively, said cleaning brush being selectively rotatable in first and second directions;

a cleaning roll rotatably contacting said cleaning brush;

a cleaning blade adapted to be pressed against said cleaning roll; and a rotation direction switching member for switching a direction of rotation of said cleaning brush between said first and second directions such that said cleaning brush is rotated in said first direction when said cleaning brush is in said first position, and said cleaning brush is rotated in said second direction when said cleaning brush is in said second position.

2. A cleaning device for a dry electrophotographic device according to claim 1, further comprising a cleaning brush engaging and disengaging member for disengaging said cleaning brush from said object when said cleaning brush is in said second position and resiliently engaging said cleaning brush with said object when said cleaning brush is in said first position.

3. A cleaning device for a dry electrophotographic device according to claim 1, further comprising a contact member provided at an upstream side of a contact portion between said cleaning brush and said cleaning roll when said cleaning brush is rotating in said second direction, said contact member contacting said cleaning brush with a prescribed contact depth.

4. A cleaning device for a dry electrophotographic device according to claim 3, wherein said contact member disengageably contacts said cleaning brush, said contact member adapted to be separated from said cleaning brush when said cleaning brush is in said first position and brought into contact with said cleaning brush when said cleaning brush is in said second position.

5. A cleaning device for a dry electrophotographic device according to claim 3, wherein said contact member constantly engages said cleaning brush.

6. A cleaning device for a dry electrophotographic device according to claim 1, further comprising means for applying a bias voltage to said cleaning brush.

7. A cleaning device for a dry electrophotographic device according to claim 1, further comprising means for applying a bias voltage to said cleaning roll.

8. A cleaning device for a dry electrophotographic device according to claim 6, wherein said bias voltage applying means is switchable between first and second states, said bias voltage applying means being in said first state when said cleaning brush is rotating in a first direction.

9. A cleaning device for a dry electrophotographic device according to claim 8, wherein said bias voltage applying means is in said second state when said cleaning brush is rotating in said second direction, said bias voltage applying means being switched from said second state to said first state substantially simultaneously with a change in the rotation direction of said cleaning brush from said second direction to said first direction such that a bias voltage is applied to said cleaning brush.

10. A cleaning device for a dry electrophotographic device according to claim 1, further comprising a housing for accommodating said cleaning roll and said cleaning brush, said device further comprising a cam mounted to contact said housing, and a spring coupled to said housing.

11. A cleaning device for a dry electrophotographic device according to claim 10, wherein said cam is rotatable between first and second positions, said cam being rotated to said first position simultaneously moving said cleaning brush to said first position to contact said object, and said cam being rotated to said second position simultaneously moving said cleaning brush to said second position to be out of contact with said object.

12. A cleaning device for a dry electrophotographic device according to claim 3, wherein said contact member comprises a flicker bar comprising a conductive material selectively engaging and disengaging said cleaning brush, said device further comprising means for selectively applying a bias voltage to said flicker bar based on the state of engagement between said flicker bar said cleaning brush.

13. A cleaning device for a dry electrophotographic device according to claim 8, wherein said bias voltage applying means applies a reverse bias voltage to said cleaning brush when said bias voltage applying means is switched to said second state.

14. A cleaning device for a dry electrophotographic device according to claim 8, wherein said second position of said bias voltage applying means is a ground position.

15. A cleaning device for a dry electrophotographic device according to claim 1, wherein said cleaning brush comprises metallic bristles.

16. A cleaning device for a dry electrophotographic device according to claim 3, wherein said contact member is movable between first and second positions, said contact member being in contact with said cleaning brush when said contract member is in said second position.

17. A cleaning device adapted to clean an object, comprising:

a rotatable brush selectively movable between a first and second position to move into and out of contact, respectively, with said object;

a roll rotatably contacting said brush to clean said brush;

a scraper adapted to engage said roll to clean said roll; and means for selectively rotating said brush in one of a first direction and a second direction based on said brush being in one of said first and second positions.

18. A cleaning device according to claim 17, further comprising an engaging and disengaging member for disengaging said brush from said object when said brush is in said second position and resiliently engaging said brush when said brush is in said first position.

19. A cleaning device according to claim 17, further comprising a contact member provided at an upstream side of a contact portion between said brush and said roll when said brush is rotating in said second direction, said contact member contacting said brush with a prescribed contact depth.

20. A cleaning device for a dry electrophotographic device adapted to clean an object, comprising:

a rotatable cleaning brush selectively movable between a first position and a second position to move into contact and out of contact with said object, respectively, said cleaning brush being selectively rotatable in first and second directions about an axis;

a driving gear provided on said cleaning brush coaxially therewith;

a cleaning roll rotatably contacting said cleaning brush;

a cleaning blade adapted to be pressed against said cleaning roll; and a rotation direction switching member for switching a direction of rotation of said cleaning brush between said first and second directions such that said cleaning brush is rotated in said first direction when said cleaning brush is in said first position, and said cleaning brush is rotated in said second direction when said cleaning brush is in said second position, said rotation direction switching member comprising a first gear provided on one side of said driving gear and a second gear provided on the other side of said driving gear, said first gear and said second gear being coupled to each other so as to be driven in concert, said driving gear being in meshing engagement with said first gear when said cleaning brush is in said first position, and said driving gear being in meshing engagement with said second gear when said cleaning brush is in said second position.

* * * * *